US011326359B2

(12) United States Patent
Guinn et al.

(10) Patent No.: US 11,326,359 B2
(45) Date of Patent: May 10, 2022

(54) CONCRETE SURFACE POLISHING TROWEL AND CONVERSION ADAPTOR

(71) Applicant: Allen Engineering Corporation, Paragould, AR (US)

(72) Inventors: Timmy D. Guinn, Paragould, AR (US); Lee T Gibson, Williamsburg, AR (US); Brian M. Adamchuk, Virginia Beach, VA (US)

(73) Assignee: Allen Engineering Corp., Paragould, AR (US)

( * ) Notice: Subject to any disclaimer, the term of this patent is extended or adjusted under 35 U.S.C. 154(b) by 157 days.

(21) Appl. No.: 16/991,672

(22) Filed: Aug. 12, 2020

(65) Prior Publication Data

US 2021/0047845 A1 Feb. 18, 2021

Related U.S. Application Data

(60) Provisional application No. 62/888,050, filed on Aug. 16, 2019.

(51) Int. Cl.
*E04F 21/24* (2006.01)
*B24B 7/18* (2006.01)

(52) U.S. Cl.
CPC ..... *E04F 21/247* (2013.01); *B24B 7/186* (2013.01); *E04F 21/248* (2013.01)

(58) Field of Classification Search
CPC ..... E04F 21/247; E04F 21/248; B24B 7/186
USPC ..... 404/112
See application file for complete search history.

(56) References Cited

U.S. PATENT DOCUMENTS

| | | | |
|---|---|---|---|
| 3,936,212 | A | 2/1976 | Holz |
| 4,046,484 | A | 9/1977 | Holz |
| 4,314,773 | A | 2/1982 | Allen |
| 4,320,986 | A | 3/1982 | Morrison |
| 4,676,691 | A | 6/1987 | Morrison |
| 4,702,640 | A | 10/1987 | Allen |
| 4,878,779 | A | 11/1989 | Whiteman |

(Continued)

FOREIGN PATENT DOCUMENTS

DE G941816 1/1999

OTHER PUBLICATIONS

"Velox T-2440" trowel, https://www.diamaticusa.com/products/grinding-polishing-machines/velox-power-trowel/.

*Primary Examiner* — Raymond W Addie
(74) *Attorney, Agent, or Firm* — Stephen D. Carver

(57) ABSTRACT

An adaptor assembly for concrete finishing trowels that enables efficient polishing of concrete surfaces, and trowels equipped with said adaptors. A large, rigid, circular adaptor disk supports a plurality of spaced-apart polishing rotors that project into contact with the concrete surface being treated. Each polishing head is rotatably secured to the adaptor disk with a spindle assembly including suitable alignment bearings. The spindle assembly secures a rigid header beneath the adaptor disk that sandwiches a resilient, annular coupler between itself and a rigid driver plate beneath the coupler. Bosses on the coupler insure spacing and enable proper flexure. The driver plate removably mounts a resilient finishing ring, that supports a plurality of radially spaced apart, downwardly projecting, diamond-equipped pucks that frictionally bear against the concrete surface for abrading and polishing.

20 Claims, 11 Drawing Sheets

(56) References Cited

U.S. PATENT DOCUMENTS

| | | | | |
|---|---|---|---|---|
| 5,108,220 | A | 4/1992 | Allen | |
| 5,562,361 | A | 10/1996 | Allen | |
| 5,613,801 | A | 3/1997 | Allen | |
| 5,816,739 | A | 10/1998 | Allen | |
| 5,816,740 | A | 10/1998 | Jaszkowiak | |
| 5,890,833 | A | 4/1999 | Allen | |
| 5,988,939 | A | 11/1999 | Allen | |
| 6,048,130 | A | 4/2000 | Allen | |
| 6,053,660 | A | 4/2000 | Allen | |
| 6,089,786 | A | 7/2000 | Allen | |
| 6,106,193 | A | 8/2000 | Allen | |
| 6,857,815 | B2 * | 2/2005 | Allen | E04F 21/242 404/112 |
| 7,108,449 | B1 | 9/2006 | Allen | |
| 7,114,876 | B1 | 10/2006 | Allen | |
| 7,147,548 | B1 | 12/2006 | Mehrabi | |
| 7,204,745 | B2 | 4/2007 | Thysell | |
| 7,226,347 | B1 | 6/2007 | Padgett | |
| 7,357,700 | B2 | 4/2008 | Lundberg | |
| 7,481,602 | B2 | 1/2009 | Lampley | |
| 7,506,644 | B2 | 3/2009 | Park | |
| 7,530,762 | B2 | 5/2009 | Copoulos | |
| 7,690,864 | B2 | 4/2010 | Allen | |
| 7,775,741 | B2 | 8/2010 | Copoulos | |
| 7,815,393 | B2 | 10/2010 | Snyder | |
| 8,388,264 | B2 | 3/2013 | Grahl | |
| 8,708,598 | B2 | 4/2014 | Hanson | |
| 9,174,326 | B2 | 11/2015 | Ahonen | |
| 10,011,999 | B2 | 7/2018 | Tchakarov | |
| 2006/0188334 | A1 * | 8/2006 | Lampley | E04F 21/245 404/112 |
| 2013/0324021 | A1 | 12/2013 | Ryan | |
| 2018/0369981 | A1 | 12/2018 | Craft | |
| 2020/0232169 | A1 * | 7/2020 | Chappel | E01C 19/42 |
| 2021/0348398 | A1 * | 11/2021 | Pelletier | E01C 19/42 |

* cited by examiner

PRIOR ART

PRIOR ART

CONCRETE SURFACE POLISHING TROWEL AND CONVERSION ADAPTOR

CROSS REFERENCE TO RELATED APPLICATION

This utility conversion patent application is based upon, and claims priority from, previously filed U.S. Provisional Patent Application Ser. No. 62/888,050, filed Aug. 19, 2019, and entitled "Surface Polishing Trowel and Conversion Kit," by co-inventors Timmy D. Guinn, Lee T. Gibson, and Brian M. Adamchuk.

BACKGROUND OF THE INVENTION

I. Field of the Invention

The present invention relates generally to the polishing of concrete surfaces such as floors. More particularly, this invention relates to retrofittable adaptor systems for both ride-on and walk behind trowels that enables them to polish concrete surfaces, and to riding trowels fitted with such systems. Riding trowels within the focus of this invention have traditionally been classified in USPC Class 404, Subclass 112, and analogous polishing pads can be found in USPC Class 451, Subclasses 521-548, and CPC Class B24D Subclasses 11/00, 13/00, and 99/005.

II. Description of the Prior Art

Surface treatments for concrete floors have evolved and improved over the years. Many forms of grinding and polishing exist. For example, motor-powered polishing or treating machines of the type comprising rotors that abrasively contact the floor or surface under treatment exist. Successful floor treatments with known treatment machines typically start with an abrasive grit and cycle towards finer grits. For example, cycling from 30-grit to 40-grit metal bonded diamond to 80-grit metal bonded diamond abrasive and then to 150-grit bonded diamond abrasive or something finer is typical. At this point in the process, a chemical hardener may be applied to the floor's surface to densify the concrete, and polishing begins thereafter. To start polishing, a 100-grit resin diamond bond, may be employed, followed by a 400-grit bond, then an 800-grit bond, concluding with the use of very fine grit ratings between 1500-level and 3500-level. After smoothing the concrete surface, a stain may be applied to the surface of the concrete.

We have found it desirable to enable concrete floor polishing with powered concrete finishing trowels, both of the walk-behind and self propelled types.

High power, multiple rotor, hydraulic riding trowels for finishing concrete are well recognized by those skilled in the art. Proper finishing insures that desired surface characteristics including appropriate smoothness and flatness are achieved. It is also important that delamination be minimized. High power, hydraulically driven riding trowels are capable of finishing large areas of plastic concrete quickly and efficiently, while insuring high quality surface characteristics.

Modern hydraulic power riding trowels comprise two or more bladed rotors that project downwardly and frictionally contact the concrete surface. In advanced machines the rotors are driven by hydraulic drive motors pressured by hydraulic pumps that are in turn powered by a separate, internal combustion engine. The riding trowel operator sits on top of the frame and controls trowel movement with a joystick steering system that tilts the rotors for control. The weight of the trowel and the operator is transmitted frictionally to the concrete by the revolving blades or pans. Frictional forces caused by rotor tilting enable the trowel to be steered.

The following U.S. patents present trowels that may benefit from the instant kit: U.S. Pat. Nos. 4,046,484, 3,936,212, 4,320,986, 4,676,691, 4,878,779, 4,977,928, 5,108,220, 5,613,801, 5,816,740, 5,890,833, 6,089,786, 6,053,660, 6,048,130, 5,816,739, 6,106,193, 6,857,815, 7,108,449, 7,114,876, 7,690,864, 8,388,264, and 8,708,598.

German Pat. No. G9,418,169.1 entitled "Concrete smoothing machine" issued Jan. 26, 1995 to Betontechnik Shumacher GmbH discloses a riding trowel.

As the concept of polishing has been added to the standard practices of panning and then blading concrete surfaces, numerous prior art systems have evolved. For example, U.S. Pat. No. 7,147,548 to Mehrabi issued Dec. 12, 2006 discloses a grinding and cutting head used with a rotating disk driven by a grinding and cutting machine. The head includes a plate mounting a carrier that includes a slot securing a diamond cutting element for surface treatment.

U.S. Pat. No. 7,204,745 to Thysell issued Apr. 17, 2007 discloses a circular cleaning disk intended for rotation by a cleaning machine. A number of recesses distributed over the active cleaning surface includes elements containing industrial diamonds used for grinding stone and concrete floors.

U.S. Pat. No. 7,226,347 to Padgett issued Jun. 5, 2007 discloses a walk behind polisher and grinder. A drive motor mounted on a frame provides rotation.

U.S. Pat. No. 7,357,700 to Lundberg issued Apr. 15, 2008 discloses polishing and grinding machine for treating concrete, terrazzo, stone and similar surfaces. Gangs of polishing heads treat concrete and similar surface flooring. A vehicle with a front loader arm supports a module containing the polishing gangs. The vehicle is capable of raising and rotating the module to easily change the pads attached to the polishing heads. Each polishing head is individually powered by a motor and floats over the floor surface. The pads attached to the polishing heads are preferably diamond-impregnated polishing pads.

U.S. Pat. No. 7,481,602 to Lampley issued Jan. 27, 2009 discloses a diamond trowel blade with diamond particles that can attach to a power trowel for surface preparation of hardened concrete surfaces.

U.S. Pat. No. 7,506,644 to Park issued Mar. 24, 2009 discloses a rotatable grinding wheel, with abrasive segments detachably connected to a disc. Abrasive segments are connected to the disc by inserting the fixing protrusions into fixing recesses.

U.S. Pat. No. 7,530,762 to Reed issued May 12, 2009 and U.S. Pat. No. 7,775,741 to Copoulos issued Aug. 17, 2010 disclose methods and apparatuses for surface finishing cured concrete floors using a riding trowel to which large diameter pans are attached. Abraders are releasably secured to the undersides of the pans.

U.S. Pat. No. 7,815,393 to Snyder issued Oct. 19, 2010 discloses an assembly for rotatably mounting a surface processing tool holder on at least one motor driven rotatable arm of a surface processing apparatus.

U.S. Pat. No. 9,174,326 to Ahonen issued Nov. 3, 2015 reveals a rotatable floor conditioning device. The instrument essentially comprises a porous washing, polishing, and waxing disk for surface treatment.

U.S. Pat. No. 10,011,999 to Tchakarov issued Jul. 3, 2018 a floor finishing apparatus including a grouting pan configured to be affixed to the rotating head of a finishing machine.

Grouting pans are rotated over a prepped surface such that the curved sidewalls trowel the mortar onto the rough composite surface and the bottom surface which is in contact with the prepped floor forces the mortar into the surface voids such that a grouted surface.

U. S. Publication No. 2013/0324021 published Dec. 5, 2013 discloses an abrasive pad for use on hard surfaces that includes a fibrous, non-woven body with an abrasive coating containing diamond-impregnated abrasive elements.

U. S. Publication No. 2018/0369981 published Dec. 27, 2018 discloses a concrete floor trowel machine with blades equipped with a floor polishing jacket or attachment. The attachment may comprise pucks attached with metallic hook-and-loop means.

Another polishing trowel, known as the "Velox T-2440" trowel, is revealed at: https://www.diamaticusa.com/products/grinding-polishing-machines/velox-power-trowel/.

SUMMARY OF THE INVENTION

This invention provides modified concrete finishing trowels for polishing or abrading concrete surfaces, and a kit that may be quickly retrofitted to existing concrete finishing trowels of various types for using them as polishers and/or grinders.

The polishing kit preferably comprises a rigid, circular disk frame that supports a plurality of spaced apart polishing heads that project into contact with the concrete surface below that is being treated. In each head a rotatable spindle with suitable bearings secures a rigid header that sandwiches a flexible coupler between itself and a rigid driver plate beneath the coupler. The driver plate removably mounts a finishing ring, that supports a plurality of radially spaced apart, downwardly projecting, diamond-equipped pucks that frictionally bear against the concrete surface for polishing.

Thus a basic object of our invention is to provide a polishing arrangement for finishing concrete surfaces.

Another important object is to enable the quick inspection and changing of abrasive polishing pads, when used.

A related object is to provide a kit for polishing concrete surfaces, that may be quickly fitted to conventional concrete finishing trowels of both walk-behind and riding configurations.

Thus a similar object is to provide walk behind finishing trowels and riding trowels with a "quick change" adaptation for polishing or abrading concrete surfaces.

Another object is to provide a concrete polishing system of the character described that allows for free-floating over the floor.

Another object is to provide a concrete polishing system of the character described that minimizes the number of heads or "pucks" required.

For labor-saving purposes it is an object to provide a concrete polishing system of the character described that facilitates quick unit inspections and relatively easy repair and maintenance.

Thus a related object is to simplify the process of replacing the abrasive polishing pads or pucks.

Yet another important object is to enable a conventional riding trowel for enhanced surface polishing while maintaining reliable, precision steering characteristics.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever practicable to indicate like parts in the various views.

DETAILED DESCRIPTION OF THE PREFERRED EMBODIMENTS

Figure 1:
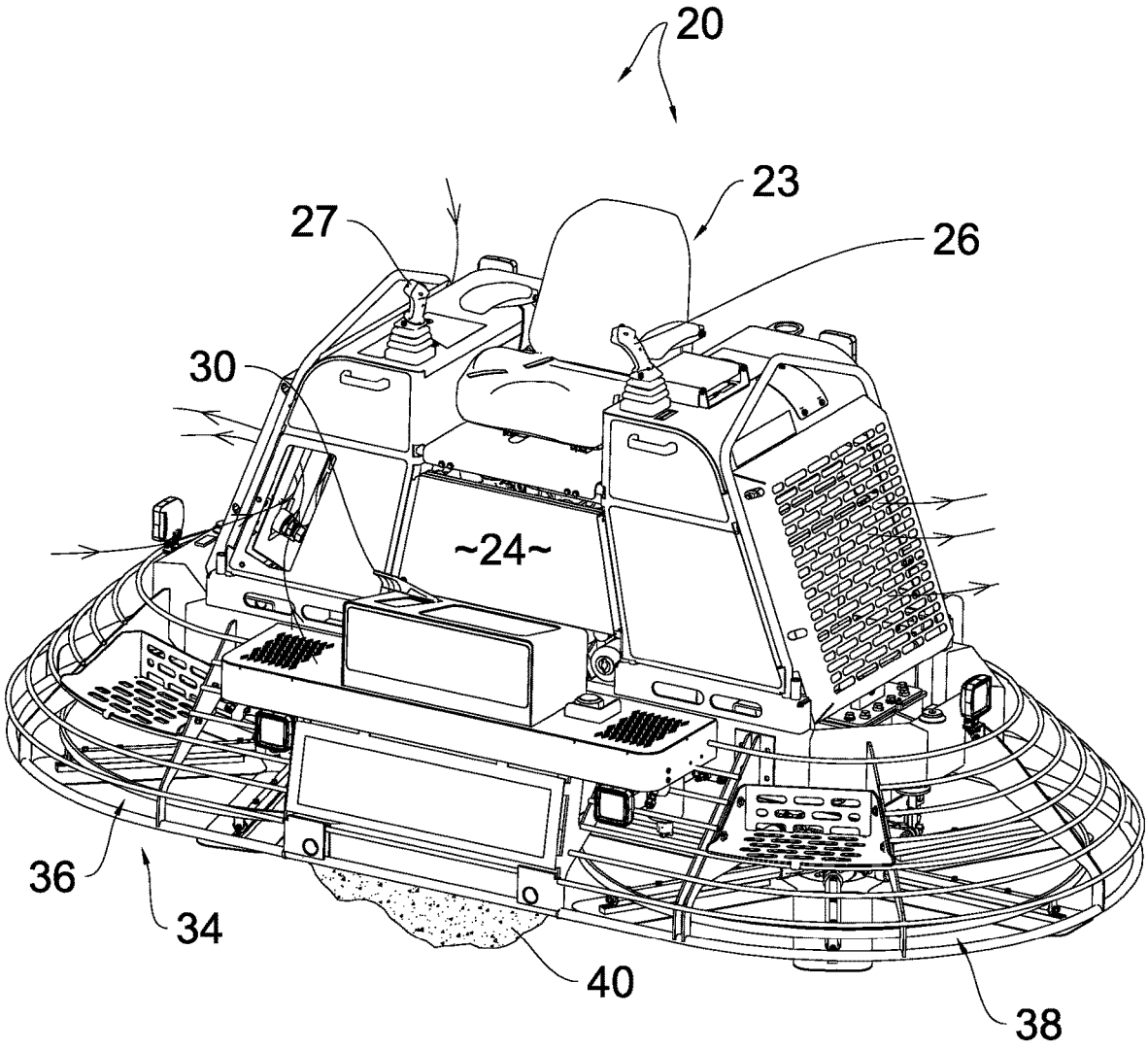
FIG. 1 is a front, isometric view of a recent hydraulically-driven and hydraulically steered, twin-rotor riding trowel that may be adapted for polishing concrete surfaces in accordance with this invention.
Figure 2:
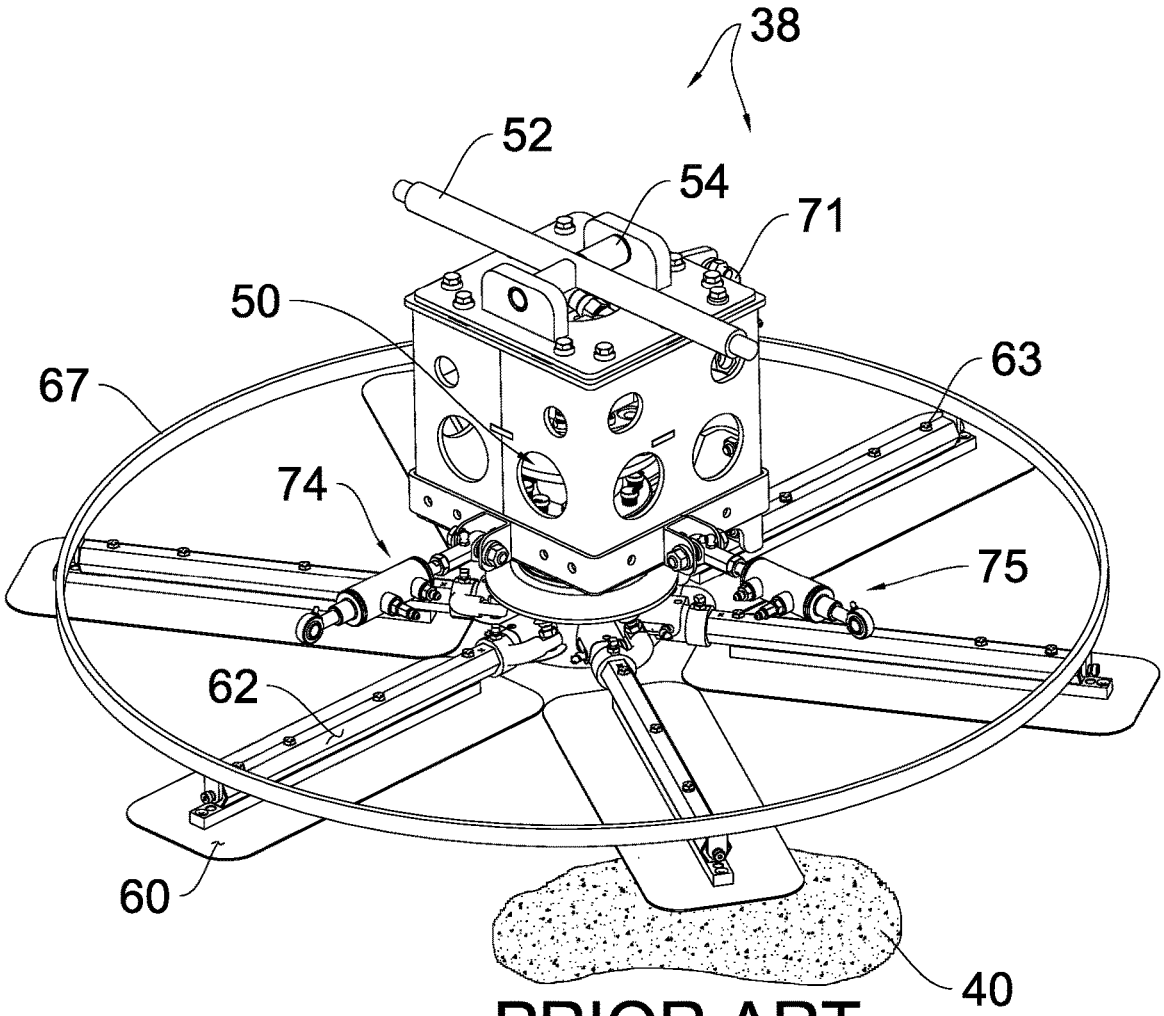
FIG. 2 is an enlarged, fragmentary, isometric view of a trowel rotor showing blade structure that engages polishing kits in accordance with the invention.

In FIGS. 1 and 2 of the accompanying drawings, reference numeral 20 generally denotes a high-power, twin-engine, hydraulic riding trowel that may be easily modified within the scope of the invention to facilitate concrete surface abrading and polishing. The above discussed Allen Engineering Corporation patents, including specifically U.S. Pat. No. 7,690,864 issued Apr. 6, 2010 entitled "Hydraulic Riding Trowel With Automatic Load Sensing System," are hereby jointly incorporated by reference, as if fully set forth herein, for purposes of disclosure.

Troweling is a common and well recognized form of concrete surface treatment. Ideally troweling begins over exposed concrete surfaces, such as floor surface 40 (FIG. 1) with panning as known in the art when the concrete is plastic. Pan troweling graduates to blading as concrete cures during the subsequent hardening stages, as is recognized in the art. However, as this technology has evolved over the years, it has become increasingly desirable to further treat the concrete surface beyond mere "blading," by polishing it to a very fine, smooth surface. It is therefore desirable to adapt currently existing riding trowels, and walk behind trowels where practicable, for polishing and fine finishing.

Jointly referencing FIGS. 1 and 2, a trowel operator (not shown) comfortably seated within seat assembly 23 (FIG. 1) can operate trowel 20 with a pair of easy-to-use joysticks 26, 27 respectively disposed at the operator's left and right side. Details for the joystick controls are illustrated profusely in one or more of the above-referenced Allen patents. Throttle control is provided by a mechanical, foot-operated pedal 30 that is accessible from seat assembly 23 located atop the frame assembly 34. A pair of spaced-apart rotor assemblies 36 and 38 dynamically coupled to the frame extend downwardly into contact with the concrete surface 40 (FIG. 1) as is well known in the art. Each rotor assembly is independently, pivotally suspended from the trowel 20 with structure detailed in several of the above-mentioned patents. Preferably, each rotor assembly is driven by a separate hydraulic motor whose hydraulic pressure is derived from one or more hydraulic pumps driven by an internal combustion engine. The self propelled riding trowel 20 is designed to quickly and reliably finish extremely large areas of concrete surface 40, with either pans or the illustrated blades.

Referring to FIG. 2, a suitable hydraulic drive motor 50 powers a rotor assembly 38. Details of the rotor pivoting function and mounting assemblies are illustrated in the previously referenced Allen patents. Rotor pivoting may be enabled by twin pivot rods 52, 54 (FIG. 2). A plurality of radially spaced-apart blades 60 associated with each rotor are driven by the hydraulic motor 50. These blades 60 are secured to rigid, radially spaced-apart trowel rotor arms 62 in the trowel blading mode. As is known in the trowel arts, each arm 62 may be revolved about its longitudinal axis for pitch control in response to a pitch control cylinder 71. Preferably a circular reinforcement ring 67 encircles and braces the revolving blades. One or two rotor tilting cylinders 74 and 75 may be used with rotor assembly 38 (FIG. 2). Details of various hydraulic circuits, circuitry interconnections, and control apparatus for hydraulic trowels are known in the art.

The radially spaced apart trowel rotor arms 62 are secured to the corresponding rotor blade 60 in substantially longitudinal, parallel alignment with typical fasteners 63 (FIG. 2). To accommodate the preferred polishing arrangement of FIG. 3 discussed below hereinafter, trowel rotor blades 60 must be removed.

Figure 3:
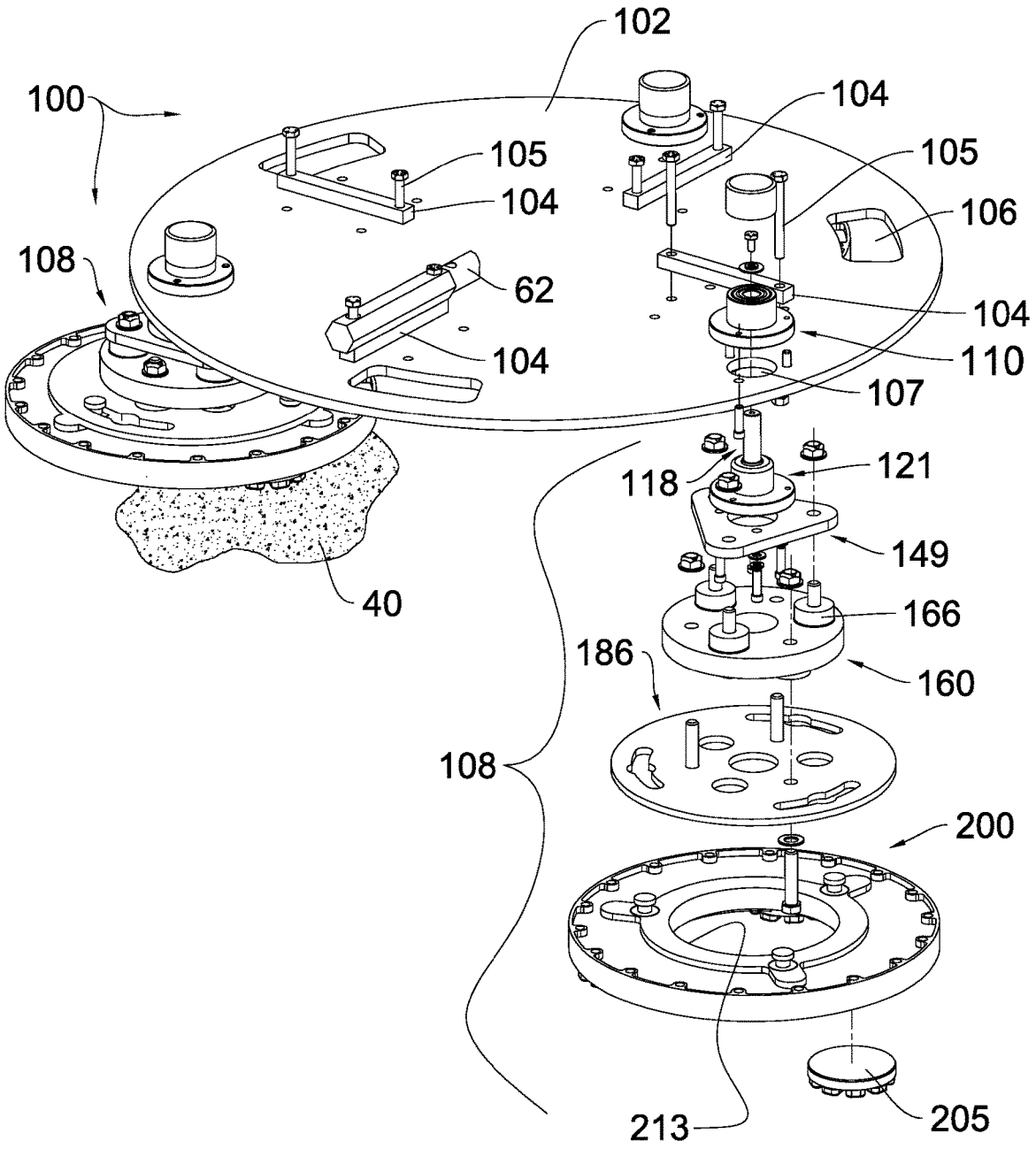
FIG. 3 is a fragmentary, partially exploded isometric view of a preferred, retrofittable polishing adaptor for concrete finishing trowels.
Figure 10:
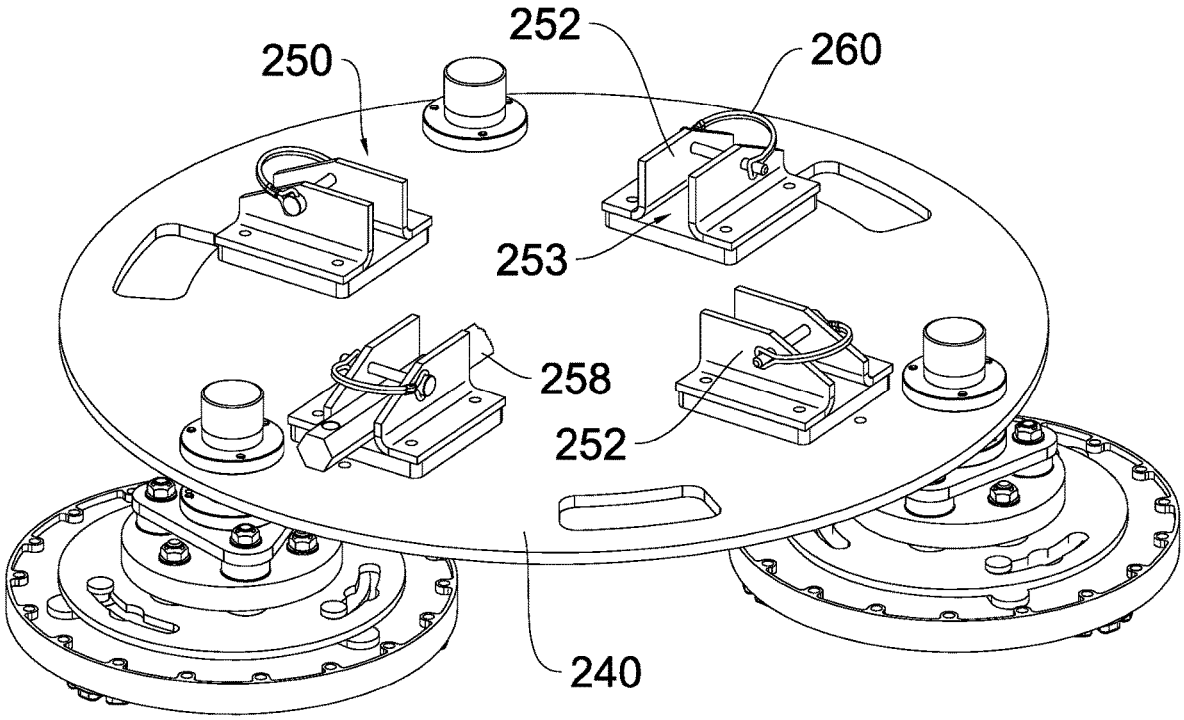
FIG. 10 is an isometric view of an alternative adaptor wherein trowel rotor arms are coupled to a modified adaptor disk with pinned, channel couplings; and, FIGS. 11 and 12 are isometric pictorial views of alternative adaptor frame disks that directly engage trowel rotor blades, obviating the need to remove the rotor blades during adaptor installation.
Figure 11:
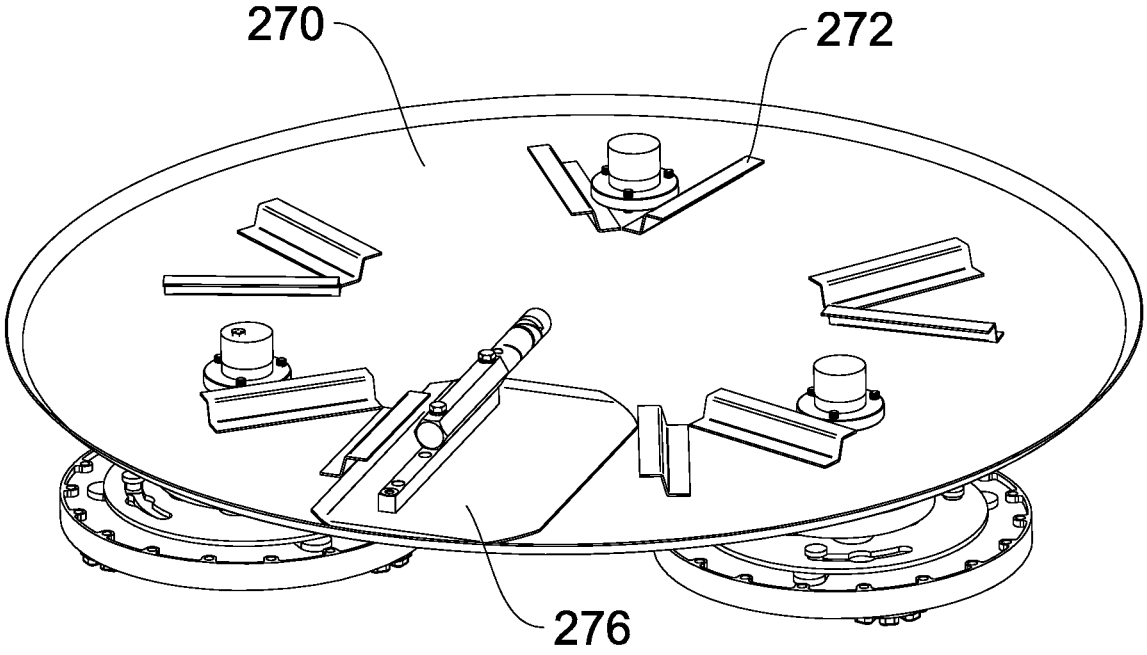
Figure 12:
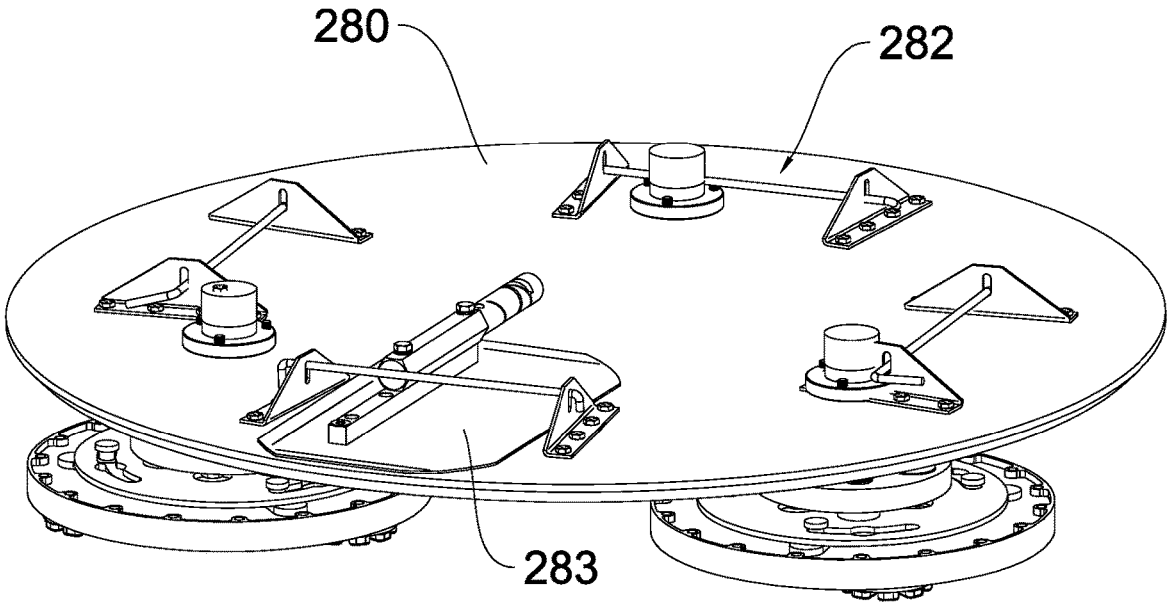

A preferred riding trowel polishing adaptor is generally designated by the reference numeral 100 (i.e., FIG. 3). The trowel rotor blade arms 62 then engage the adaptor 100 as illustrated in either FIG. 3, the primary embodiment, or as illustrated in FIGS. 10-12, showing alternative designs.

The major portions of adaptor 100 are a rigid, circular frame disk 102, and a plurality of radially spaced apart, downwardly projecting, polishing heads 108 mounted on the frame disk 102 as detailed below.

Structural strength and unit rigidity are established by the large, circular, preferably aluminum frame disk 102 that supports various components, acting as a rigid support. Means for coupling the frame disk 102 to the trowel rotor are provided. In the best mode of the invention known at this time, frame disk 102 may comprise a plurality of radially spaced apart mounting bars 104 (FIG. 3) that may be secured to frame disk 102 by suitable fasteners 105 (i.e., preferably bolts). The number of mounting bars 104 on the frame disk 102 will correspond to and align with the number of rotor blades used by a given trowel rotor. As seen in FIG. 3, fasteners 105 may be passed through the trowel rotor arms 62 (i.e., once the trowel blades 60 are removed), to firmly and concentrically secure the adaptor frame disk 102 to the trowel rotor, thus securing the adaptor 100. While the preferred mounting arrangement seen in FIG. 3 has exhibited the best trowel steering characteristics in use, alternative means for coupling an adaptor frame disk to riding trowel rotors are discussed below (i.e., FIGS. 10-12).

Preferably frame disk 102 comprises a plurality of radially spaced apart, gripping orifices 106 penetrating the disk for adaptor manipulation and handling, thus aiding installation. There are also a plurality of radially spaced apart mounting orifices 107 defined in the frame disk 102 for securing the individual polishing heads 108 which are mounted below the adapter's frame disk 102 (i.e., FIG. 3).

In the best mode known at this time there are preferably three radially spaced apart, downwardly projecting polishing heads 108 secured to the adaptor frame disk 102. It is contemplated that more polishing rotors can be used when properly sized and spaced apart.

Figure 4:
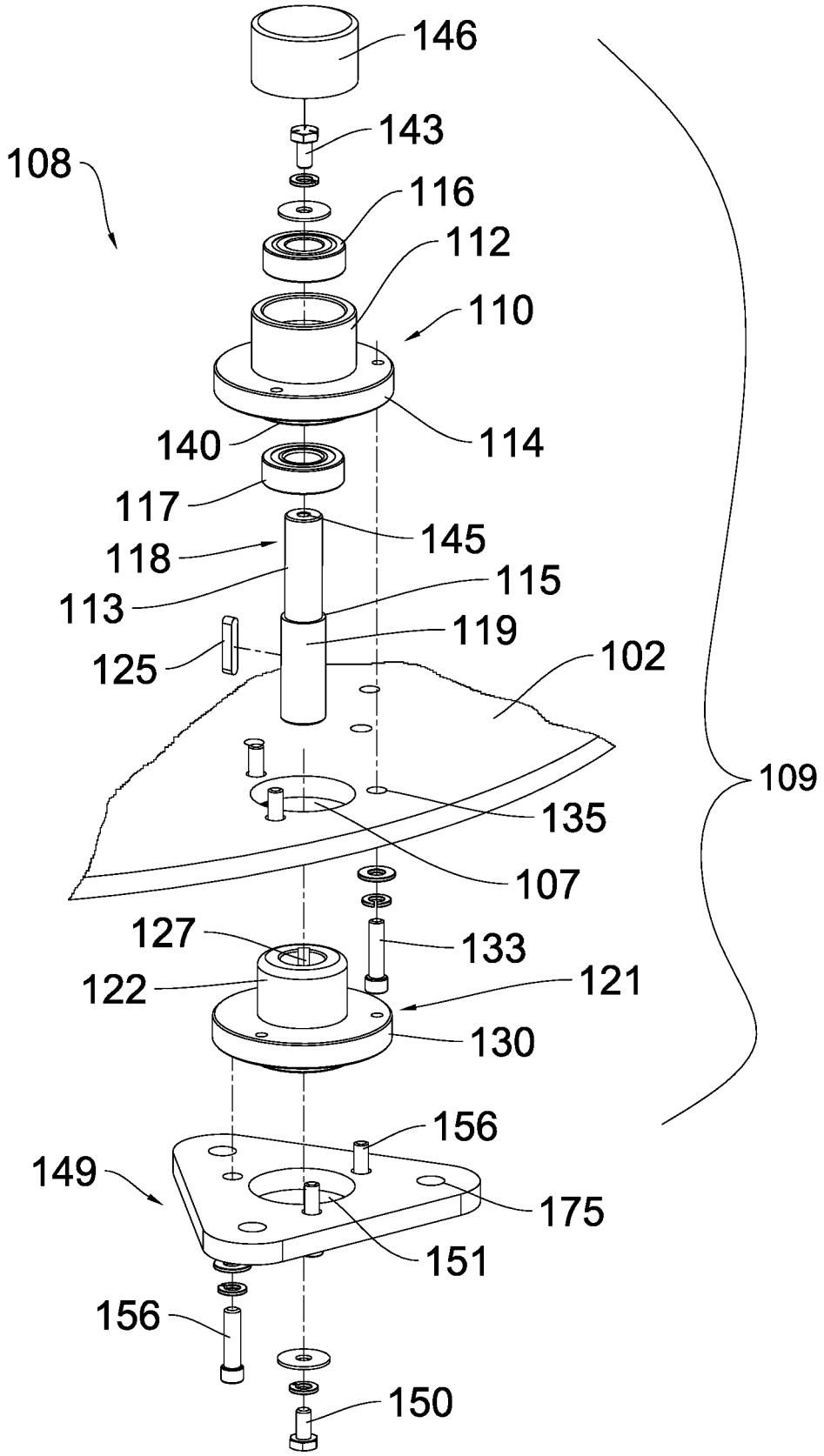
FIG. 4 is an enlarged, fragmentary, exploded isometric assembly view of the spindle and header assembly of FIG. 3.

With concurrent reference to FIGS. 3 and 4, each polishing head 108 comprises a spindle assembly 109 facilitating rotation. The preferred spindle assembly 109 interconnects and rotatably mounts a header 149 described below that secures additional components beneath frame disk 102. Spindle assembly 109 comprises an upper bearing housing 110 with a tubular rise 112 extending concentrically upwardly from an annular flange 114. An upper bearing 116 is housed within rise 112 and penetrated by an axle 118 leading below to a shaft housing 121. Axle 118 has an upper portion 113 and an aligned, larger diameter lower portion 119 with a shoulder stop 115 defined therebetween. The flange portion 114 of bearing housing 110 fits atop frame disk 102 concentrically with an orifice 107 (FIG. 4). A lower bearing 117 fits within the underside of bearing housing 110, and helps preserve axial alignment of axle 118 in cooperation with bearing 116. Axle 118 penetrates an orifice 107 and connects to a lower shaft housing 121 that is similar to bearing housing 110 described above. The somewhat larger diameter axle lower portion 119 fits within a rise 122 concentric with flange 130, which, in assembly, is disposed beneath the frame disk 102. The shoulder 115 stop preferably defined on axle 118 supports bearing 117.

A locking key 125 mates within a slot 127 (FIG. 4) defined in rise 122. Flanges 130 and 114 are held together with suitable fasteners 133, preferably bolts, penetrating orifices 135 surrounding orifices 107. A bottom, concentric rim 140 at the underside of bearing housing 110 concentrically mates within rise 122 in assembly with flange 114 contacting the top surface of frame disk 102. Similarly, the shaft bearing flange 130 will contact the underside of disk 102 in assembly. An upper fastener 143 (FIG. 4), preferably a bolt, is secured to axle 118 within threaded orifice 145. A lower bolt 150 penetrates a rigid, somewhat triangular header 149 through an orifice 151 (FIG. 4), being received within the lower portion 119 of axle 118, to hold the assembly together. Preferably a dust cap 146 shrouds bearing housing 110, frictionally engaging rise 112.

Figure 5:
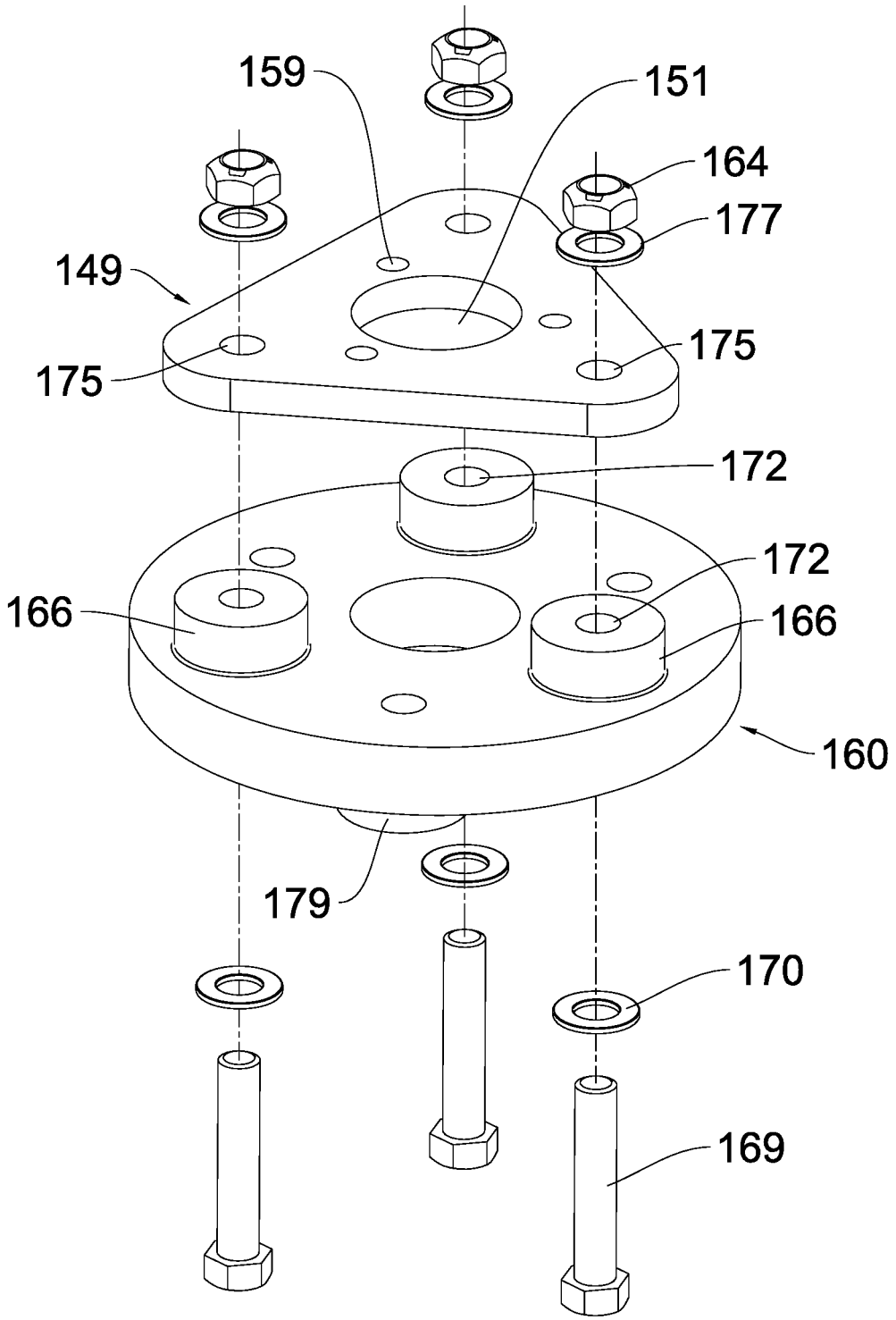
FIG. 5 is an enlarged, exploded isometric assembly view detailing the preferred header and flexible coupling.
Figure 6:
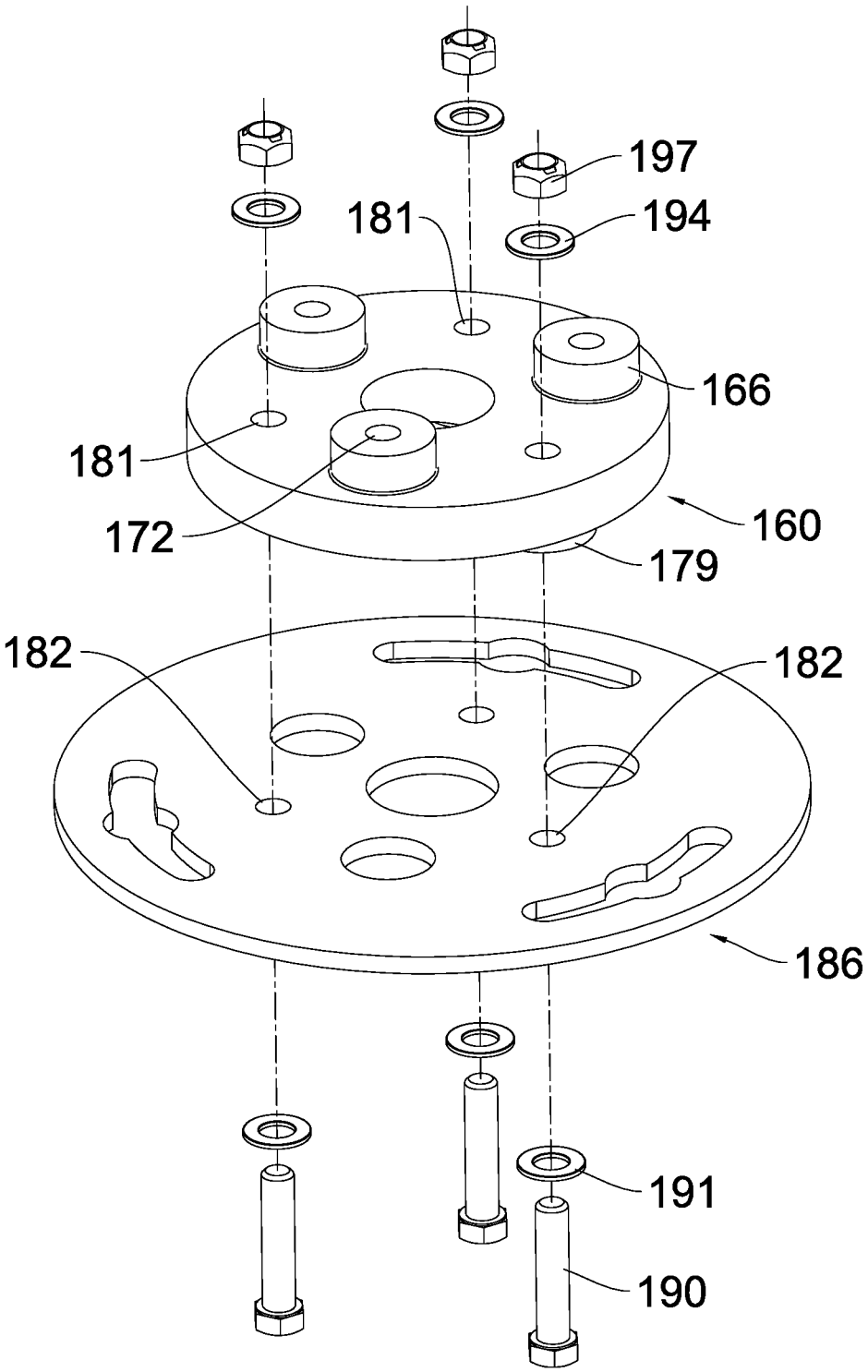
FIG. 6 is an enlarged, exploded isometric assembly view detailing the preferred flexible coupling and the rigid driver plate.

The preferred header 149 has a generally triangular appearance. This configuration establishes clearance for through bolts penetrating orifices 181, thus aiding flexure. Header 149 mates to the underside of flange 130, which is secured to the header with suitable bolts 156 (FIG. 4) that penetrate header orifices 159 (FIG. 5). Header 149 is secured to and controls a flexible, resilient, annular coupler 160 (FIGS. 3-5) that has a plurality of radially spaced apart, upper bosses 166 that may be integrally formed on its top. Suitable fasteners, i.e., bolts 169 (i.e., FIG. 5) that penetrate washers 170, boss orifices 172, header orifices 175 and washers 177 threadably engage nuts 164 and tighten and secure the coupler 160 to the header 149. Upper bosses 166 space the coupler from the header 149. Lower bosses 172 space the coupler 160 from the driver plate 186 (FIG. 6).

Flexing of coupler 160 is aided by a plurality of preferably integral, radially spaced apart lower bosses 179 (i.e., FIG. 6), projecting downwardly from the coupler bottom. Bosses 179 are radially offset from the upper bosses 166, occupying positions coaxial with orifices 181 at the coupler underside.

The lower bosses 179 (i.e., FIG. 6), which are aligned with radially spaced apart orifices 182 defined in rigid driver plate 186 (FIG. 7), receive through-bolts 190 that also penetrate washers 191, driver plate orifices 182, flexible coupler orifices 181, and washers 194, being terminated by retainer nuts 197. In this manner the flexible coupler 160 is sandwiched between header 149 (i.e., FIG. 5) and driver plate 186 (i.e., FIGS. 6,7) to allow suitable "give" (i.e., flexure and slight bending) of each polishing head 108 during use. Bosses 166 provide adequate spacing for clearance of nut 197 and washer 194 during flexure of polishing head 108.

Figure 7:
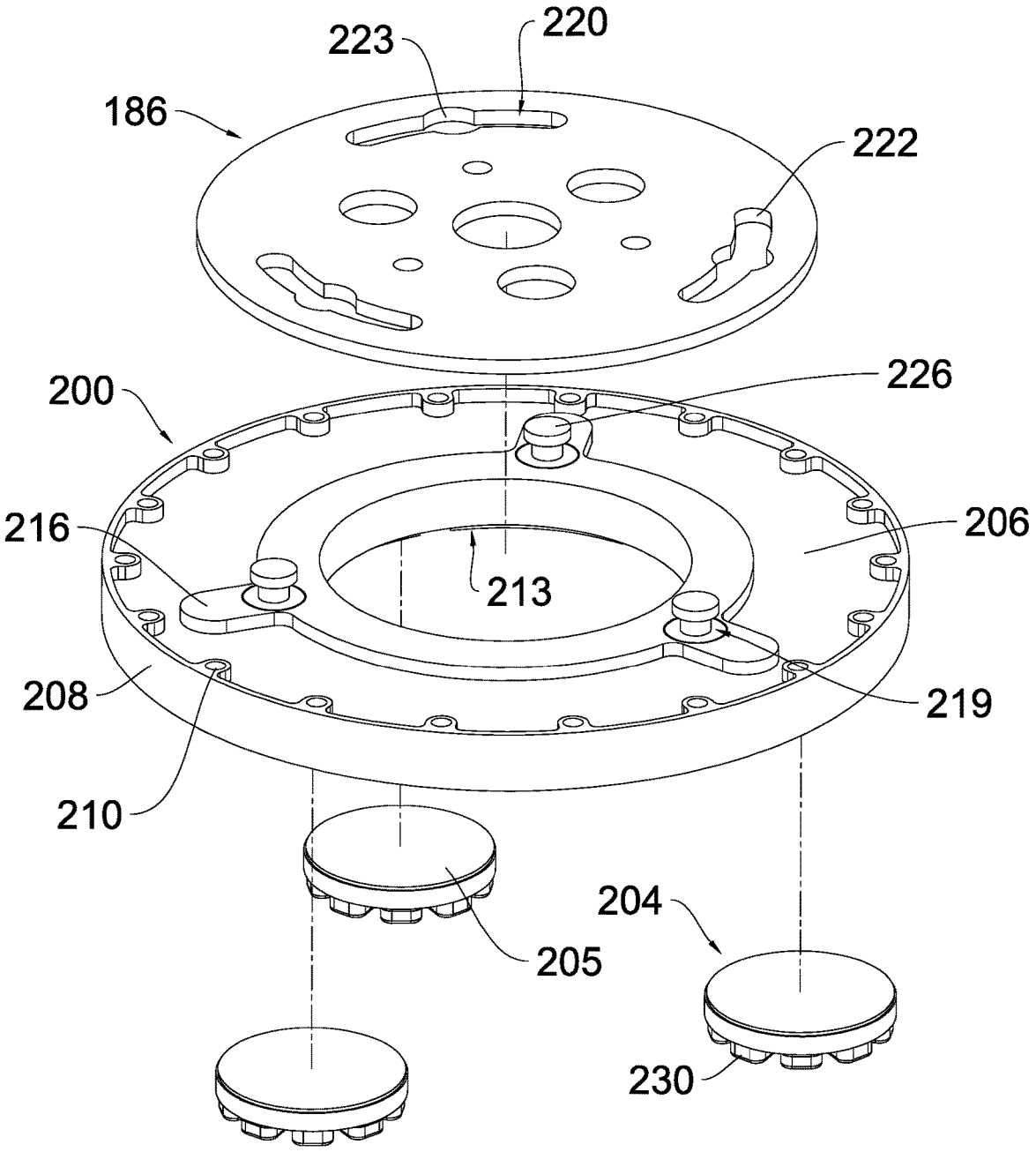
FIG. 7 is an enlarged, exploded isometric assembly view detailing the preferred driver plate, the preferred polishing ring, and the abrasive pucks.
Figure 8:
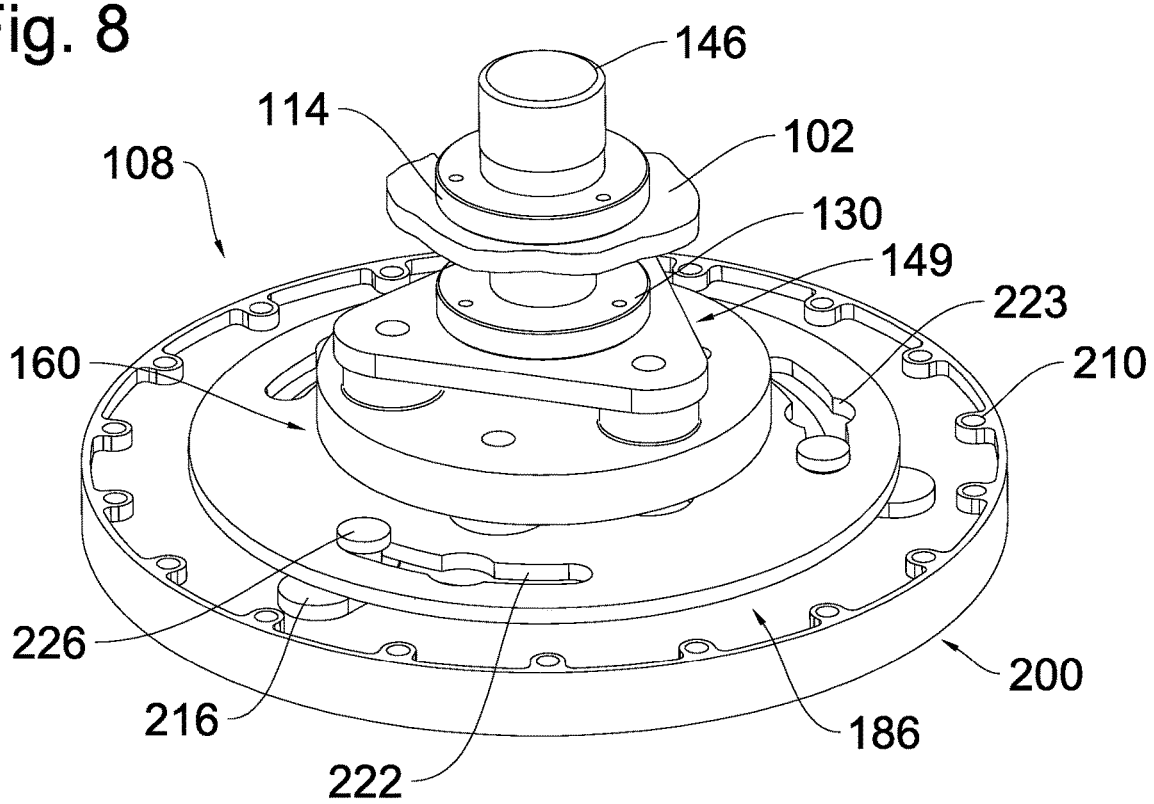
FIG. 8 is an isometric view of an assembled adaptor.
Figure 9:
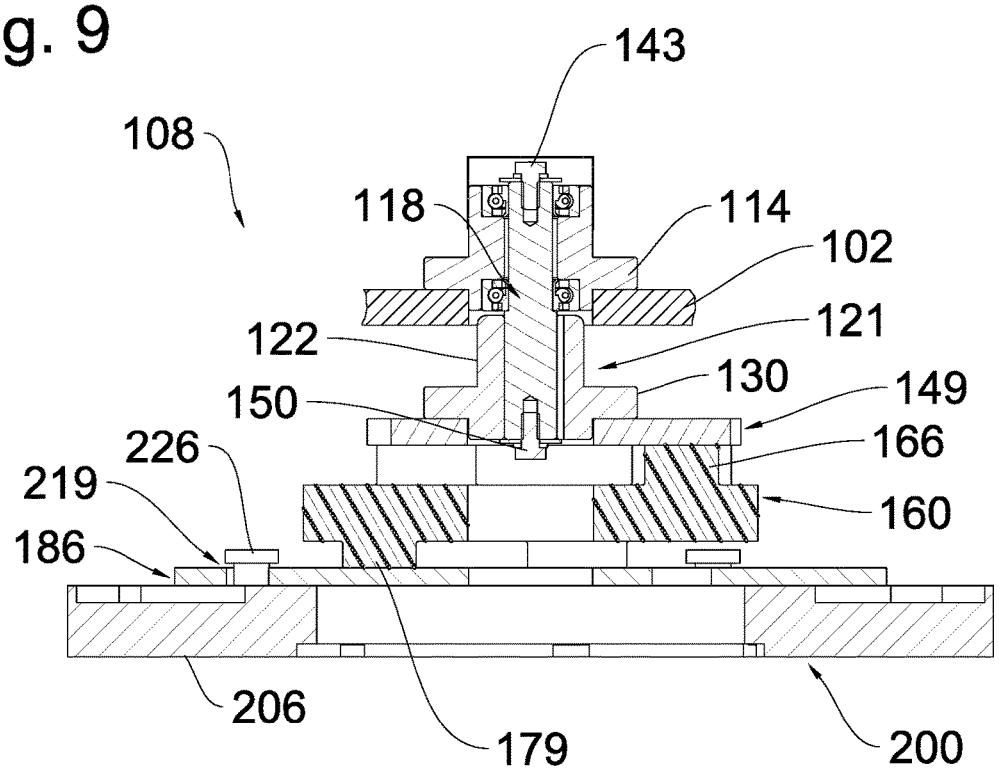
FIG. 9 is a vertical sectional view of the assembled adaptor of FIG. 8.

As best seen in FIG. 7, the rigid driver plate 186 removably and concentrically mounts a resilient polishing ring 200 that is somewhat flexible. Ring 200 mounts a plurality of downwardly projecting abrasive projections 204 (FIG. 7). The polishing ring 200 preferably comprises an annular, inner flexible portion 206 coaxially bounded by a peripheral wall 208 that optionally comprises a plurality of radially spaced apart, peripheral sockets 210. The wall 208 coaxially surrounds a rigid, inner collar 213 comprising rigid, radially spaced apart tabs 216 bordering upwardly projecting, lugs 219. It will be noted that the lug caps 226 may be passed through the arcuate slots 220 that are radially spaced apart within driver plate 186 (FIG. 7). Slots 220 each comprise curved wing portions 222 (i.e., FIG. 8) that border a central circular, clearance orifice 223 that is sized to pass the caps 226 of the polishing ring lugs 219. With the removable polishing ring 200 so fitted to the driver plate 186, relative rotation of the polishing ring 200 relative to driver plate 186 secures the two parts together, as the lug caps 226 travel within the driver plate slots 220, with the caps unable to withdraw axially through the slot wing portions 222.

Preferably the polishing ring 200 (FIG. 7) comprises a modified Malish brand device, model number YOE7813L800. At its underside the polishing ring 200 supports a plurality of smaller, radially spaced apart, downwardly-projecting abrasion projections 204 that contact the concrete being finished. These abrasion projections 204 may include abrasive portions comprising diamond elements, carborundum components, sanding surfaces, abrasive pads and/or other abrasive components or materials. Preferably the abrasion projections 204 comprise removable, abrasive diamond segment pucks 205 known in the art that have downwardly projecting, diamond interfaces 230 that frictionally contact the concrete surface being treated. These pucks 205 may be removably secured to the underside of the polishing ring 200 within radially spaced apart recesses that seat the pucks, and secure them with hook and loop fasteners such as Velcro-brand fastening material. Alternatively the pucks 205 may be secured by suitable fasteners penetrating the peripheral sockets 210 defined in polishing ring 200 (FIG. 7) that may include a suitable clasp (not shown) to grip the pucks and removably secure them in place as is known in the art. The pucks may be changed during a polishing treatment, starting with course 100 grit, changing to a finer grit such as 400 grit, and ending with a very fine grit, such as 1500 grit, as is known in the art.

As mentioned earlier, an adaptor frame disk may be coupled to a trowel rotor through alternative means shown in FIGS. 10-12. Initially referring to FIG. 10, one alternative frame disk 240 is secured to the trowel blade arms 62 as illustrated. In this version, there are a plurality of radially spaced apart, receptacles 250 secured atop alternative frame disk 240. There is one receptacle for each trowel rotor arm. Each receptacle 250 comprises a pair of rigid, spaced apart walls 252 defining a channel 253 (FIG. 10) between them. An illustrated portion of a trowel blade arm has been designated by the reference numeral 258. The arm portion 258 is received within a channel 253 (FIG. 10) defined between walls 252. Once a blade arm 258 is seated within a channel 253, a retainer 260 is deployed between channel walls 252 with the blade arm 258 beneath it, and thus secured. The illustrated and preferred retainers 260 comprise wire lock clevis pins that are known in the art, but other types of quick-release pins and clasps are acceptable.

FIGS. 11 and 12 show alternative means for coupling a disk or pan to a trowel rotor, which are described in detail in U.S. Pat. No. 7,114,876 issued to Allen Engineering Corporation on Oct. 3, 2006, which is hereby incorporated by reference. In FIG. 11 an alternative frame disk 270 has a plurality of radially spaced apart receptacles 272 comprising Allen-type "Z-clips" that can directly engage trowel rotor blades 276, obviating the need to remove trowel blades during adaptor installation.

In FIG. 12 an alternative frame disk 280 is provided with a plurality of radially spaced-apart receptacles 282 comprising Allen "safety-catches" that can directly engage trowel rotor blades 283. However, steering with dual-rotor riding trowels using a pair of frame disks 270 or 280 has not proven as effective as the arrangement illustrated in FIG. 3 discussed earlier.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. An adaptor for converting a concrete finishing trowel for polishing, the trowel comprising at least one downwardly projecting, rotatable rotor that contacts a concrete surface for finishing, the adaptor comprising:

a rigid frame disk adapted to be engaged by and rotated by a trowel rotor;

at least one polishing head supported beneath said frame disk that contacts the concrete surface below;

a spindle rotatably supporting the at least one polishing head for rotation beneath said frame disk;

a rigid header supported by said spindle;

a flexible coupler secured to said header;

a rigid driver plate secured beneath said flexible coupler;

a polishing ring coupled to said driver plate; and, a plurality of radially spaced apart, abrading projections extending downwardly from said polishing ring for concrete polishing.

2. The adaptor as defined in claim 1 wherein the coupler is resilient and comprises a plurality of radially spaced-apart upper bosses projecting upwardly to space said coupler from said header, a plurality of radially spaced apart lower bosses projecting downwardly to space said driver plate from said coupler, thereby enabling flexure of said polishing head as it moves over said concrete surface.

3. The adaptor as defined in claim 2 wherein the driver plate removably and concentrically mounts the polishing ring.

4. The adaptor as defined in claim 3 wherein the abrading projections comprise diamond-equipped pucks that frictionally bear against the concrete surface for polishing.

5. The adaptor as defined in claim 3 wherein the frame disk comprises a plurality of radially spaced apart receptacles for engaging the trowel rotor.

6. The adaptor as defined in claim 5 wherein the receptacles comprise spaced apart walls defining a channel between them for receiving at least a portion of a trowel rotor.

7. The adaptor as defined in claim 5 wherein the receptacles comprise safety-catches for engaging at least a portion of a trowel blade.

8. The adaptor as defined in claim 5 wherein the receptacles comprise Z-clips for engaging at least a portion of a trowel blade.

9. A trowel comprising:

at least one rotatable rotor; and, an adaptor for converting said trowel to a polisher, the adaptor comprising:

a rigid frame disk adapted to be engaged by and rotated by said trowel rotor;

at least one polishing head supported beneath said frame disk that contacts the concrete surface below;

a spindle rotatably supporting the at least one polishing head for rotation beneath said frame disk;

a rigid header supported by said spindle;

a flexible coupler secured to said header;

a rigid driver plate secured beneath said flexible coupler;

a polishing ring coupled to said driver plate; and, a plurality of radially spaced apart, abrading projections extending downwardly from said polishing ring for concrete polishing.

10. The trowel as defined in claim 9 wherein the coupler is resilient and comprises a plurality of radially spaced-apart upper bosses projecting upwardly to space said coupler from said header, a plurality of radially spaced apart lower bosses projecting downwardly to space said driver plate from said coupler, thereby enabling limited flexure of said polishing head as it moves over said concrete surface.

11. The trowel as defined in claim 9 wherein the driver plate removably and concentrically mounts the polishing ring.

12. The trowel as defined in claim 9 wherein the abrading projections comprise diamond-equipped pucks that frictionally bear against the concrete surface for polishing.

13. The trowel as defined in claim 9 wherein the frame disk comprises a plurality of radially spaced apart receptacles for engaging the trowel rotor.

14. The trowel as defined in claim 13 wherein the receptacles comprise spaced apart walls defining a channel between them for receiving at least a portion of a trowel rotor.

15. The trowel as defined in claim 13 wherein the receptacles comprise safety-catches for engaging at least a portion of a trowel blade.

16. The trowel as defined in claim 13 wherein the receptacles comprise Z-clips for engaging at least a portion of a trowel blade.

17. A concrete polishing trowel comprising:

at least one rotatable rotor;

a rigid frame disk adapted to be engaged by and rotated by said trowel rotor;

at least one polishing head supported beneath said frame disk that contacts the concrete surface below;

a spindle rotatably supporting the at least one polishing head for rotation beneath said frame disk;

a rigid header supported by said spindle;

a resilient, flexible coupler secured to and spaced below said header;

a rigid driver plate secured beneath and spaced from said flexible coupler;

a polishing ring removably coupled to said driver plate; and, a plurality of radially spaced apart, abrading pucks extending downwardly from said polishing ring for concrete polishing.

18. The trowel as defined in claim 17 wherein the coupler comprises a plurality of radially spaced-apart upper bosses for flexibly spacing said coupler below said header, and plurality of radially spaced apart lower bosses projecting downwardly for flexibly spacing said driver plate from said coupler, thereby enabling limited flexure of said polishing head as it moves over said concrete surface.

19. The trowel as defined in claim 18 wherein the frame disk comprises a plurality of radially spaced apart receptacles for engaging the trowel rotor.

20. The trowel as defined in claim 19 wherein the receptacles are selected from the group consisting of:

a pair of spaced apart walls defining a channel between them for receiving at least a portion of a trowel rotor;

safety-catches for engaging at least a portion of a trowel blade; and,

Z-clips for engaging at least a portion of a trowel blade.

* * * * *